US008876667B2

(12) United States Patent
Russotti

(10) Patent No.: US 8,876,667 B2
(45) Date of Patent: Nov. 4, 2014

(54) WEIGHTED WRIST BAND WITH AN OFFSET CUFF

(76) Inventor: Jeremy Russotti, Windsor, CA (US)

( * ) Notice: Subject to any disclaimer, the term of this patent is extended or adjusted under 35 U.S.C. 154(b) by 234 days.

(21) Appl. No.: 13/506,477

(22) Filed: Apr. 23, 2012

(65) Prior Publication Data

US 2013/0281262 A1 Oct. 24, 2013

(51) Int. Cl.
*A63B 23/14* (2006.01)

(52) U.S. Cl.
USPC ..... 482/44

(58) Field of Classification Search
CPC ..... A63B 23/14; A63B 23/16
USPC ..... 482/44–50; 36/2 R; 2/60, 62, 16; 602/21, 27, 63–65; 446/26–28
See application file for complete search history.

(56) References Cited

U.S. PATENT DOCUMENTS 1,729,209 A * 9/1929 Curtice ..... 482/105
3,369,258 A 2/1968 Smith
3,490,766 A * 1/1970 Gardner ..... 482/105
3,490,768 A 1/1970 Archer
4,247,097 A 1/1981 Schwartz
4,364,564 A * 12/1982 Lewis ..... 473/415
4,556,215 A 12/1985 Tarbox et al.
4,575,075 A 3/1986 Tarbox et al.
4,756,525 A 7/1988 Whitsitt
5,802,615 A 9/1998 Wenk
6,168,556 B1 1/2001 Saavedra
6,554,752 B2 * 4/2003 Cook ..... 482/105
6,561,958 B2 5/2003 Pappert

* cited by examiner

*Primary Examiner* — Loan N Thanh
*Assistant Examiner* — Megan Anderson
(74) *Attorney, Agent, or Firm* — Welsh Flaxman & Gitler LLC

(57) ABSTRACT

A weighted wrist band or wrist cuff utilized during sport training or exercise. The weighted wrist band includes a gel mold provided with a plurality of metallic chips therein to be inserted into a pouch within the weighted wrist band. The weighted wrist band includes a first section, a second section and an offset cuff section provided between the first section and the second section. The upper edge of the offset cuff section is spaced below the upper edge of the first section and the second section, thereby resulting in the offset cuff section being offset from the first and second sections. This configuration would prevent any contact of the weighted wrist band with any sports implement during training or exercise.

5 Claims, 8 Drawing Sheets

WEIGHTED WRIST BAND WITH AN OFFSET CUFF

BACKGROUND OF THE INVENTION

1. Field of the Invention

The present invention is directed to the field of exercise and sports training, particularly to a weighted wrist band utilized with various sports implement during training.

2. Description of the Related Art

Ankle and wrist weights have been used for many years in exercise training regiments, as well as in assisting individuals in perfecting the use of a particular sports implement.

For example, ankle weights have been used for many years to develop increased jumping ability in basketball players. Typically, ankle weights are secured around a basketball player's ankles during exercise, as well as in practice basketball games. When the ankle weights are removed and the basketball player participates in a basketball game, the jumping ability of the basketball player is increased.

Similarly, it has been found that swinging multiple baseball bats, or a single weighted baseball bat, during warm-ups increases the speed of the ball player's swing while batting during actual games. Subsequently, a weighted disc was developed to be removably provided on the barrel of the baseball bat, allowing the ball player to practice swinging with an added weight. When the weight is removed from the barrel of the baseball bat, the speed of a baseball player's swing has also been found to increase.

Additionally, it has been found that providing a weighted wrist band around a golfer's hand or wrist enhances the golfer's ability to increase the speed of the golf club swing. It has also been found that applying weights to the wrist of a player swinging a racket, as well as other sports implements, results in increased swing speed when the wrist weights are removed and the athlete swings in a conventional manner. It is appreciated the use of wrist weights can be expanded to basketball, volleyball and numerous other sports.

The use of hand or wrist weights has been described, for example, in U.S. Pat. No. 3,490,766 to Gardner, U.S. Pat. No. 3,490,768 to Archer, U.S. Pat. No. 4,575,075 to Tarbox, U.S. Pat. No. 4,556,215 to Tarbox, U.S. Pat. No. 4,756,525 to Whitsitt, U.S. Pat. No. 6,168,556 to Saavedra and U.S. Pat. No. 6,561,958 to Pappert, as well as in U.S. Patent Application Publication No. 2006/0046912 to Tomlin.

The hand exercise weights illustrated in the two patents to Tarbox are generally employed to develop the arm and upper body muscles. As illustrated in the drawings of the '075 patent and the '525 patent, a portion of the hand exercise weight is provided across the palm of an individual, thereby making it difficult to effectively utilize these hand exercise weights when an individual is swinging a sports implement, such as, but not limited to, a golf club, a baseball bat, a tennis racket, a racketball racket or a squash racket. Such positioning of the hand exercise weight also interferes with athletes shooting a basketball, or practicing with a volleyball. Although the wrist bands illustrated in the patents to Gardner and Pappert do not extend across the user's palm, they do terminate in a straight line in proximity to the top of the wrist near the user's palm. The utilization of these wrist bands interferes with the use of a sports implement such as a golf club, baseball bat or tennis racket when the user is wearing the wrist band.

While practicing a particular sport, it is important that the practice session mimic the participation in the actual sport or game. For instance, if the weighted wrist band is used when an individual is practicing shooting a basketball, it is crucial the "feel" of the basketball in the individual's hand as the basketball is released be the same as when the basketball is released during an actual basketball game. This is also true with respect to practicing the skills of volleyball. This is not accomplished if a portion of the weighted wrist band comes into contact with the basketball or volleyball during a practice session. Similarly, if a portion of the weighted wrist band contacts a sports implement, such as a baseball bat, golf club or racket, the "feel" of that implement would be different during a practice session when compared to the use of the sports implement during an actual game (without the use of the weighted wrist band).

Additionally, the patent to Pappert utilizes a weight insert composed of metal plates carried by a cylindrical spring clip. The utilization of metallic elements or sand provided in a pocket of a wrist band would produce a wrist band whose weights were not particularly stable as they would likely shift when the user moves his or her hand.

U.S. Pat. No. 3,108,285 to Turnidge et al., U.S. Pat. No. 3,369,258 to Smith, U.S. Pat. No. 4,247,097 to Schwartz, and U.S. Pat. No. 5,802,615 to Wenk illustrate various gloves provided with a weight included in a pocket. The '285 patent to Turnidge includes a pocket filled with finely particulate lead or other suitably heavy metallic materials. The '097 patent to Schwartz shows a weighted glove having pockets into which bags of weighted particles such as fine lead shot are inserted. The '615 patent to Wenk describes a weighted golf glove having a pouch into which a weighted material, such as sand, lead powder or lead shot, is provided. As with the patent to Pappert, the use of granular metallic elements produces a weighted glove whose weights are not particularly stable.

The '258 patent to Smith discusses a glove provided with a weight pocket including a thin layer of metal shot which is secured inside of the pocket by a flexible adhesive layer of a material such as rubber cement. As can be appreciated, it would be relatively difficult to insert the weighted material into the pocket. Additionally, the weighted material is provided within the pocket, and it cannot be removed.

SUMMARY OF THE INVENTION

The present invention overcomes the deficiencies of the prior art by providing a weighted wrist band which includes a single band of fabric adapted to be secured around the wrist of an individual by appropriate fastening devices, such as, but not limited to, a VELCRO® type hook and loop fastener. A pouch is provided in at least one section of the continuous band into which weighted elements, such as a plurality of metallic elements integrated within a rubber gel mold, are inserted.

In addition, the periphery of a section of the band is curved to prevent the weighted wrist band from coming between the users hand and the sports implement, such as a baseball bat, a golf club, a tennis racket or similar device, being gripped. That is, the weighted wrist band is positioned upon the user's wrist such that it is substantially prevented from coming into contacted with the sports implement when the individual is wearing the weighted wrist band and is practicing with the sports implements.

The band is provided with a first end section, a second end section and a cuff section included between the first end section and the second end section. The upper edge of the cuff section is spaced below the upper edge of the first end section and the upper edge of the second end section, thereby resulting in the cuff section being offset from the first and second end sections.

Therefore, it is an object of the present invention to utilize a weighted wrist band constructed in such a manner to allow an individual to wear the weighted wrist band while utilizing a sports implement, without a surface of the wrist band contacting the sport implement while in the hand of the individual.

It is a further object of the present invention to provide a weighted wrist band to allow an individual to swing a golf club, baseball bat, tennis racket, racketball racket, squash racket or similar implements without the sports implement contacting the weighted wrist band.

It is yet another object of the present invention to provide a weighted wrist band in a manner to allow an individual to shoot a basketball or play volleyball without the basketball or volleyball contacting a portion of the weighted wrist band.

It is a further object of the present invention to provide a weighted wrist band utilizing a stable, non shifting weight within the weighted wrist band.

It is yet another object of the present invention to provide a weighted wrist band having a first section, a second section and a cuff section provided between and offset from the first and second sections.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as a basis for teaching one skilled in the art how to make and/or use the invention.

Figure 1:
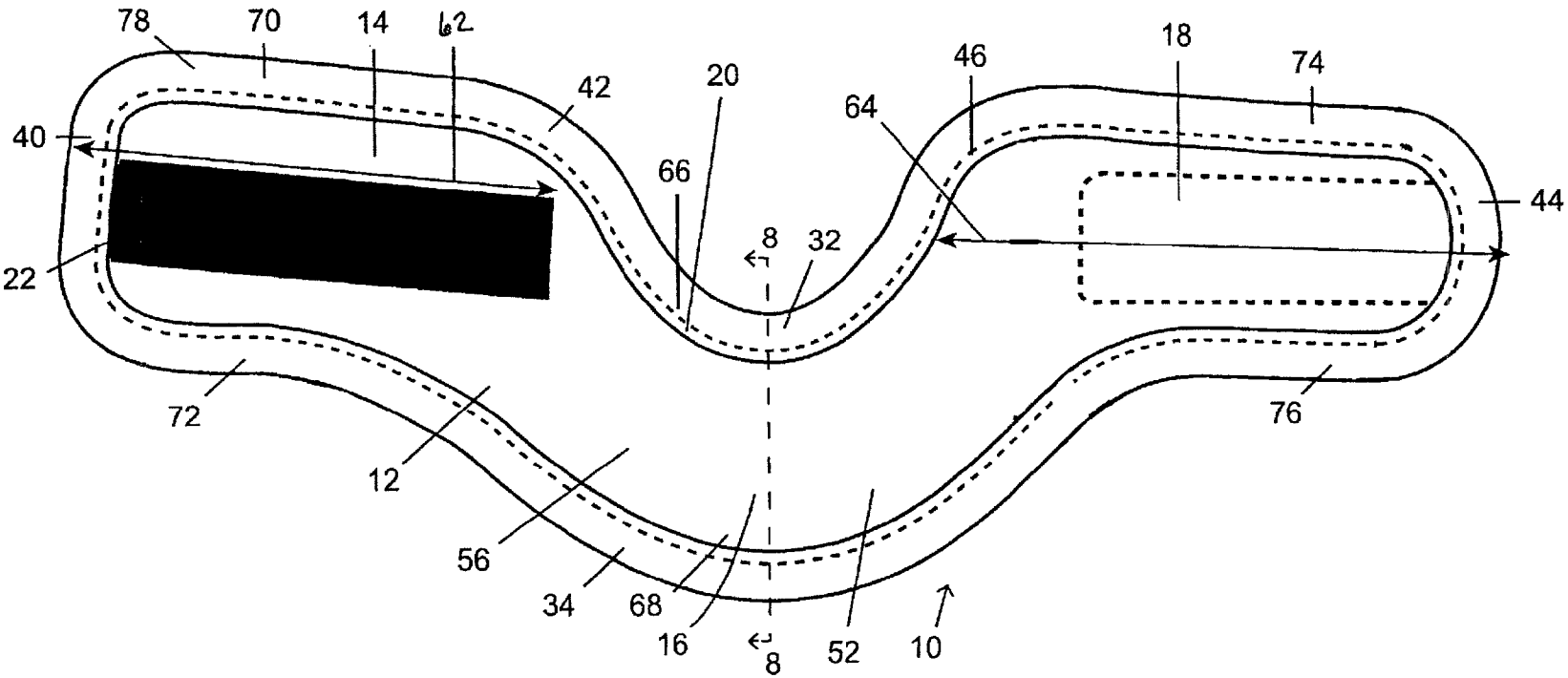
FIG. 1 is a plan view of the top surface of the weighted wrist band applied around the right wrist of a user.
Figure 2:
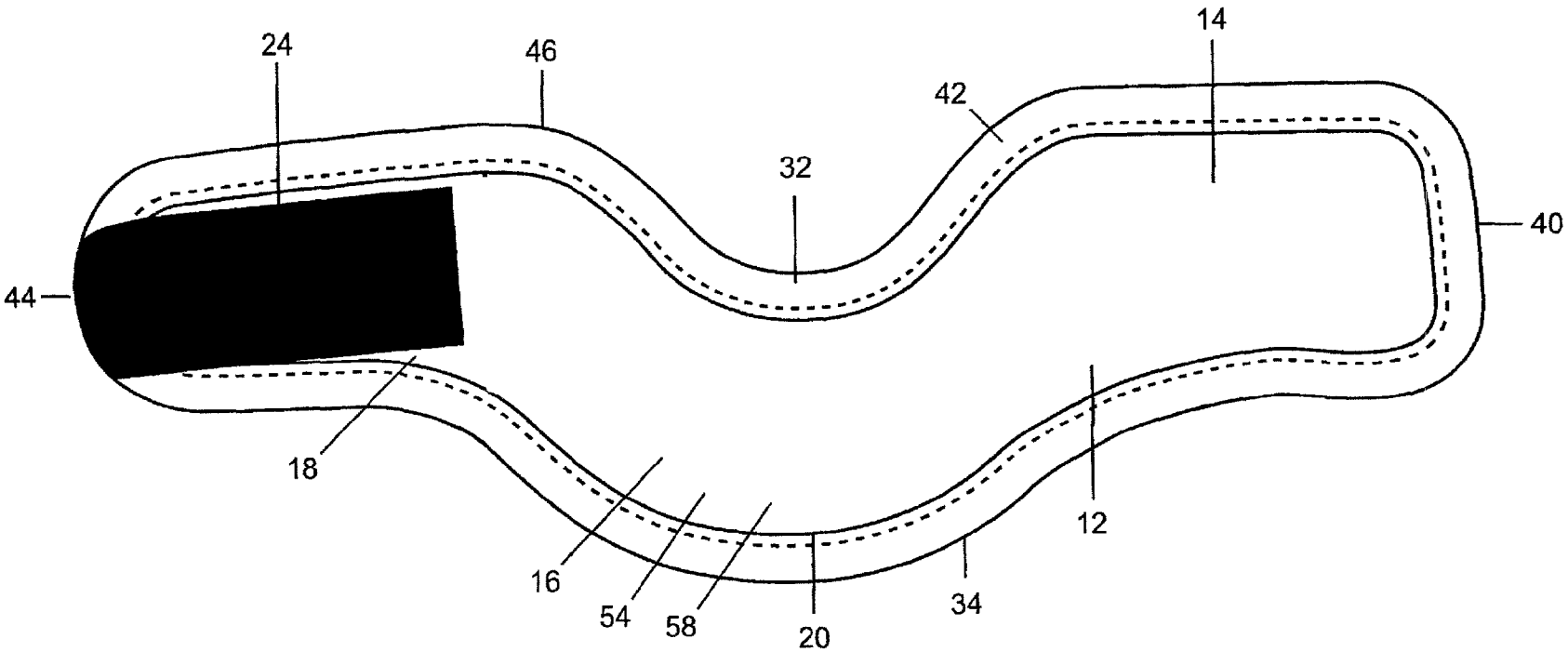
FIG. 2 is a plan view of the bottom surface of the weighted wrist band applied around the right wrist of a user.
Figure 4:
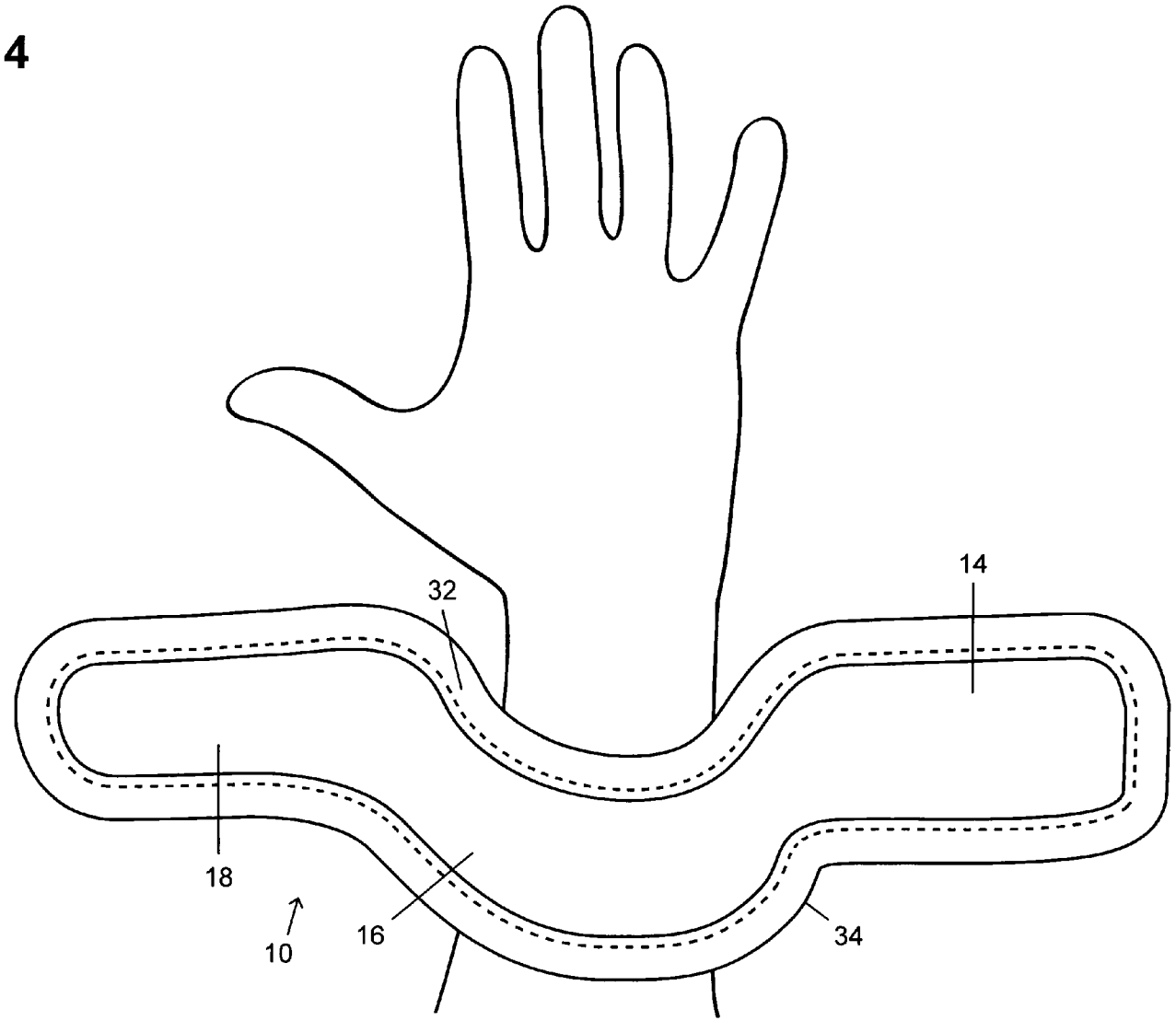
FIG. 4 is a view showing how the weighted wrist band is applied around a user's left wrist.
Figure 8:
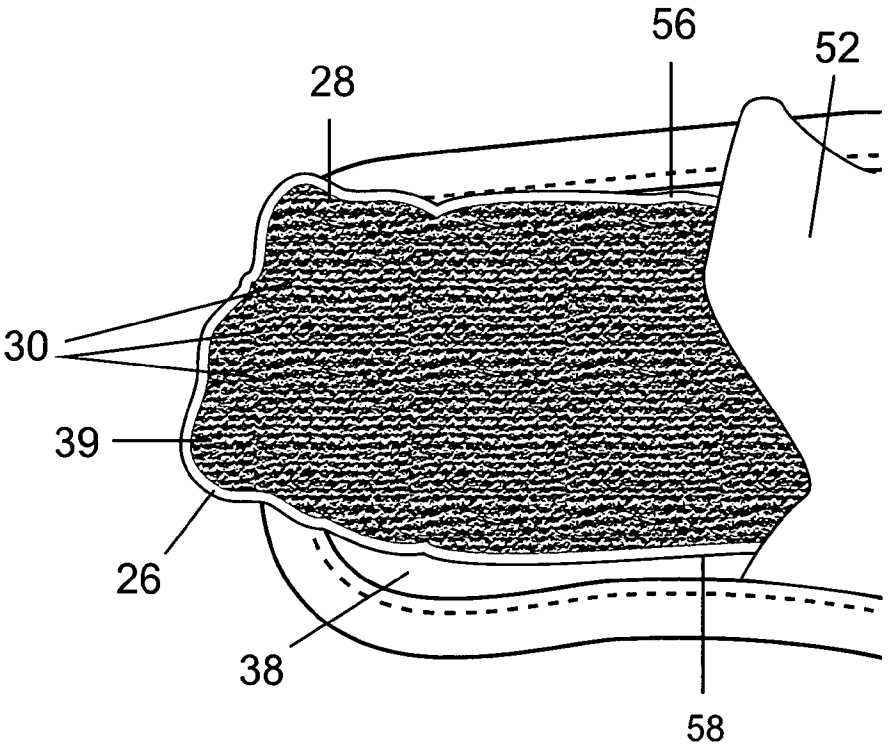
FIG. 8 is a cross sectional view of the weighted wrist band along the line 8-8 in FIG. 1.

In accordance with the present invention, and with reference to FIGS. 1, 2 and 8, a top surface 52 and a bottom surface 54 of the weighted wrist band 10 are illustrated. The weighted wrist band 10 disclosed with reference to various figures described herein is designed to be worn on the right wrist of a user, although it is well appreciated the concepts underlying the present invention could readily be applied in the manufacture of a weighted wrist band to be worn about the left wrist of a user as shown in FIG. 4.

Figure 3:
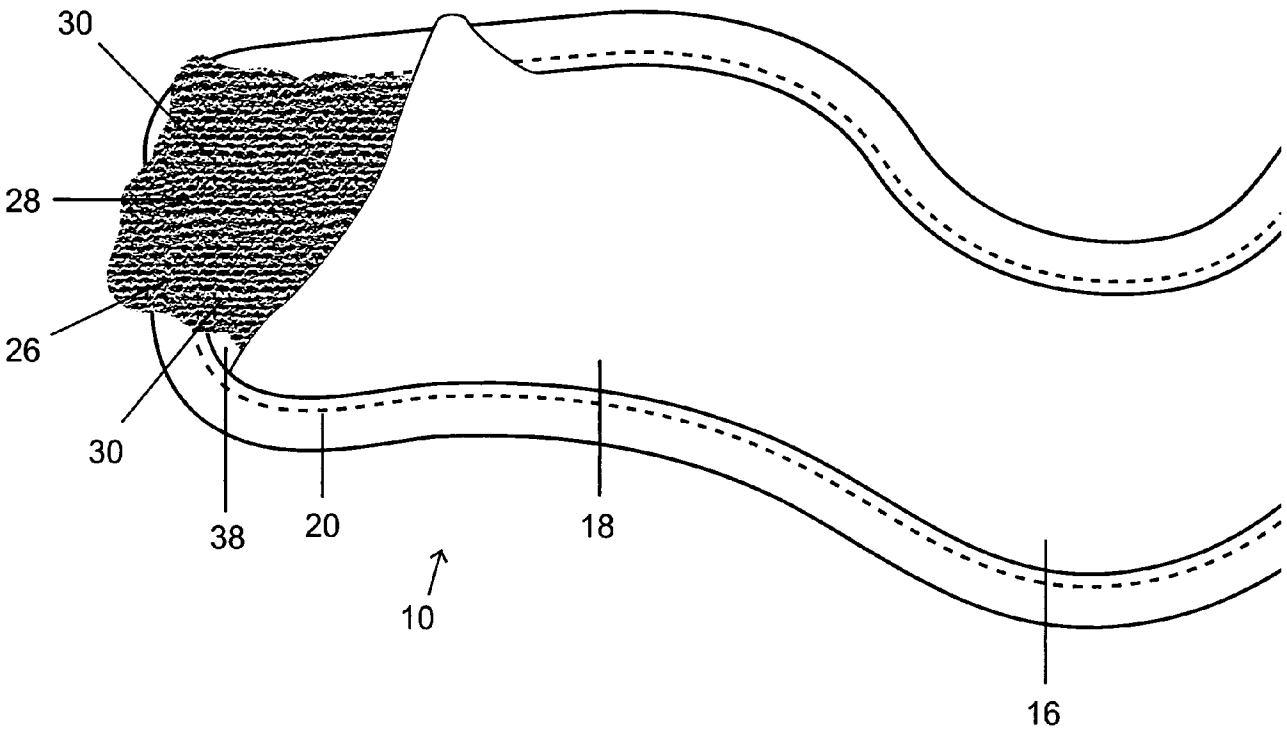
FIG. 3 is a plan view of the bottom surface of the weighted wrist band showing weighted material provided in the interior of the weighted wrist band.

The weighted wrist band 10 includes a fabric band 12 provided with a first end section 14, a second end section 18 and an offset cuff section 16 provided between the first end section 14 and the second section 18. The fabric band 12 is constructed of two opposed sheets of materials, that is, a first sheet of material 56 defining the top surface 52 of the weighted wrist band 10 and a second sheet of material 58 defining the bottom surface 54 of the weighted wrist band 10, secured together along their edges so as to define a pouch 38 therebetween. A pouch 38 is, therefore, provided in at least one of the first end section 14, the second end section 18 and the offset cuff section 16. At least one of the sections 14, 16, 18 is provided with a weighted insert 26 as illustrated in FIGS. 3 and 8. It is appreciated, that the weighted insert is shown only in the first end section 14 and the offset cuff section 16. However, a weighted inserted may also be positioned within the second end section 18.

In accordance with the present invention, the weighted insert 26 is a rubber gel mold 28 having a plurality of metallic chips 30 integrated within a rubber gel 29. The metallic chips 30 are preferably made from iron or a similar material.

The use of the rubber gel mold 28 allows a large number of metallic chips to be clustered together in a continuous, integral mass 39 while allowing the mold to take the same shape as the pouch into which the mold is inserted to avoid shifting of the weight insert 26 within the pouch 38 during use of the weighted wrist band 10. During construction of the weighted wrist band 10, one or more of these weighted inserts 26 are provided in one or more of the pouches 38 between the first sheet of material 56 and the second sheet of material 58 from which the fabric band 12 is fabricated. The first sheet of material 56 and the second sheet of material 58 are sewn together along their respective edges as shown by seam 20. On one side of the first end section 14, that is, the top surface 52 in accordance with a preferred embodiment of the present invention, one half of a hook and loop type fastening device 22 is provided. A complementary hook and loop type fastening device 24 is provided on the opposite side, that is, the bottom surface 54 in accordance with a preferred embodiment, of the second end section 18. The hook and loop fastening devices 22, 24 operate to selectively secure first end section 14 to the second end section 18 when the weighted wrist band 10 is wrapped around the wrist of a user to form a continuous band.

For the purpose of the following disclosure, it should be appreciated that FIGS. 1 and 2 show the weighted wrist band 10 lying in a single plane. As such, the first end section 14, the second end section 18 and the offset cuff section 16 all lie in the same plane. The first end section 14 includes a free end 40 and a coupled end 42 connected directly to the first end of the offset cuff section 16, while the second end section 18 includes a free end 44 and a coupled end 46 connected directly to second end of the offset cuff section 16. With the weighted wrist band 10 lying in the single plane, the first end section 14 includes a longitudinal axis 62 extending from the free end 40 thereof to the coupled end 42 thereof along the lateral mid-point of the first end section 14. Similarly, the second end section 18 includes a longitudinal axis 64 extending from the free end 44 thereof to the coupled end 46 thereof along the lateral mid-point of the second end section 18. The longitudinal axis 62 of the of the first end section 14 and the longitudinal axis 64 of the second end section 18 are aligned and coextensive.

The first end section 14 also includes a generally straight upper edge 70 and a generally straight lower edge 72 where the seam 20 holds the first sheet of material 56 to the second sheet of material 58 and the second end section 18 includes a generally straight upper edge 74 and a generally straight lower edge 76 where the seam 20 holds the first sheet of material 56 to the second sheet of material 58.

As with the longitudinal axes 62, 64 of the respective first end section 14 and the second end section 18, a line 78 extending along the upper edge 70 of the first end section 14 and extending along the upper edge 74 of the second end section 18 are aligned and coextensive.

The offset cuff section 16 as shown in FIG. 1, which is positioned between and secured to the respective first end section 14 and the second end section 18, includes a curved periphery 32 formed by an upper peripheral edge 66 and is, therefore, not parallel to or coextensive with the longitudinal axis 62 of the of the first end section 14 and the longitudinal axis 64 of the second end section 18. The offset cuff section 16 exhibits a partial annular shape and may include a curved lower peripheral edge 34.

As shown in FIGS. 1 and 8, the offset cuff section 16 includes a curved upper edge 66 and a curved lower edge 68 where the seam 20 holds the first sheet of material 56 to the second sheet of material 58. With the pouch 38 positioned between the curved upper edge 66 and the curved lower edge 68, the upper edge 66 defines a concave surface, that will fit beneath the heel of the palm as discussed below in greater detail. The curved lower edge 68 defines a convex surface.

As a result, and considering the coextensive longitudinal axes 62 of the of the first end section 14 and the second end section 18, the straight upper edge 70 of the first end section 14 and the straight upper edge 74 of the second end section 18 are respectively coupled to the ends of the curved upper edge 66 of the offset cuff section 16. Similarly, the straight lower edge 72 of the first end section 14 and the straight lower edge 76 of the second end section 18 are respectively coupled to the ends of the curved lower edge 68 of the offset cuff section 16.

As shown in FIG. 1, the curved upper edge 66 of the offset cuff section 16 is spaced below the generally straight upper edge 70 of the first end section 14 and the generally straight upper edge 74 of the second end section 18. The upper edge 66 of the offset cuff section 66 is offset from line 78 formed by the upper edge 70 and 74.

When the weighted wrist band 10 is properly applied to the wrist of an individual, the curved periphery 32, that is, the curved upper edge 66 of the offset cuff section 16, ensures there would be no contact between the weighted wrist band 10 and the heel of the palm of a user and/or an implement such as, but not limited to, a basketball, golf club, racket or volleyball when the weighted wrist band 10 is worn during sports training.

With reference to FIG. 4, the weighted wrist band 10 is about to be applied to the left wrist of an individual. When positioning the weighted wrist band 10 for application about the wrist of a user, it is important to note that the curved periphery 32 is positioned at the front of the user's hand, just below the palm. In particular, the weighted wrist band 10 is oriented in a substantially flat configuration similar to that shown with reference to FIGS. 1 and 2. The hand and wrist of the user is then positioned along the bottom surface 54 of the weighted wrist band 10 with the heel of the user's palm positioned adjacent to the curved upper edge 66 with the curved upper edge 66 extending about the heel of the user's palm. With the weighted wrist band 10 properly positioned in this manner, the first end section 14 and the second end section 18 are drawn toward the back of the users hand/wrist and the hook and loop fastening devices 22, 24 are brought into engagement retaining the weighted wrist band 10 about the user's wrist.

Figure 5:
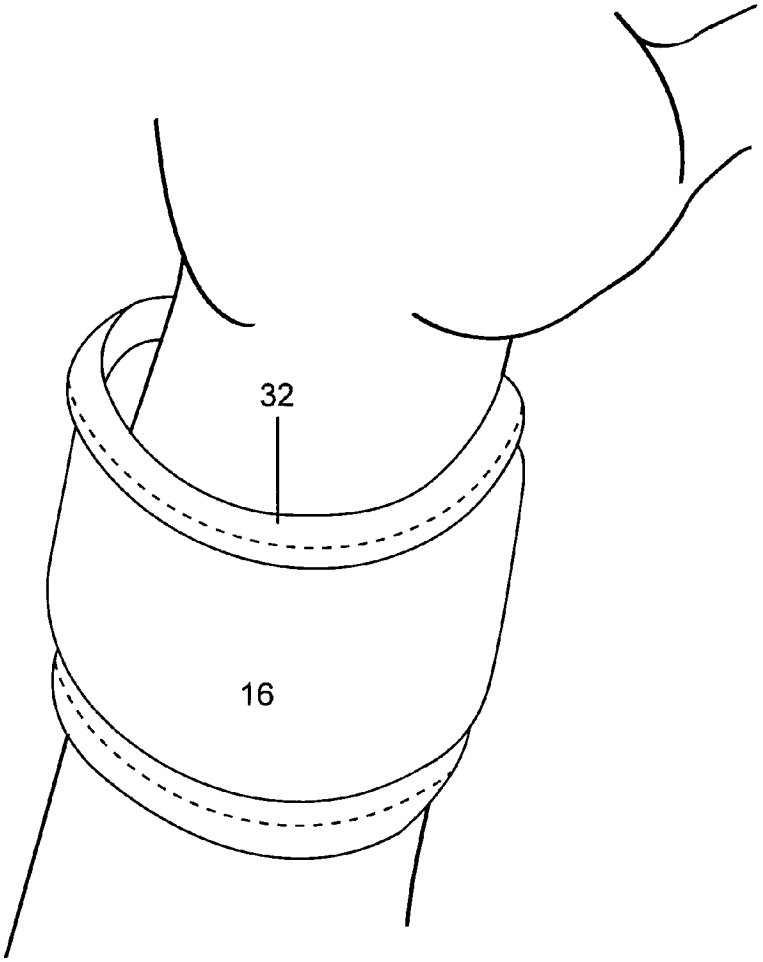
FIGS. 5, 6 and 7 show perspective views of the weighted wrist band around a user's right wrist.
Figure 6:
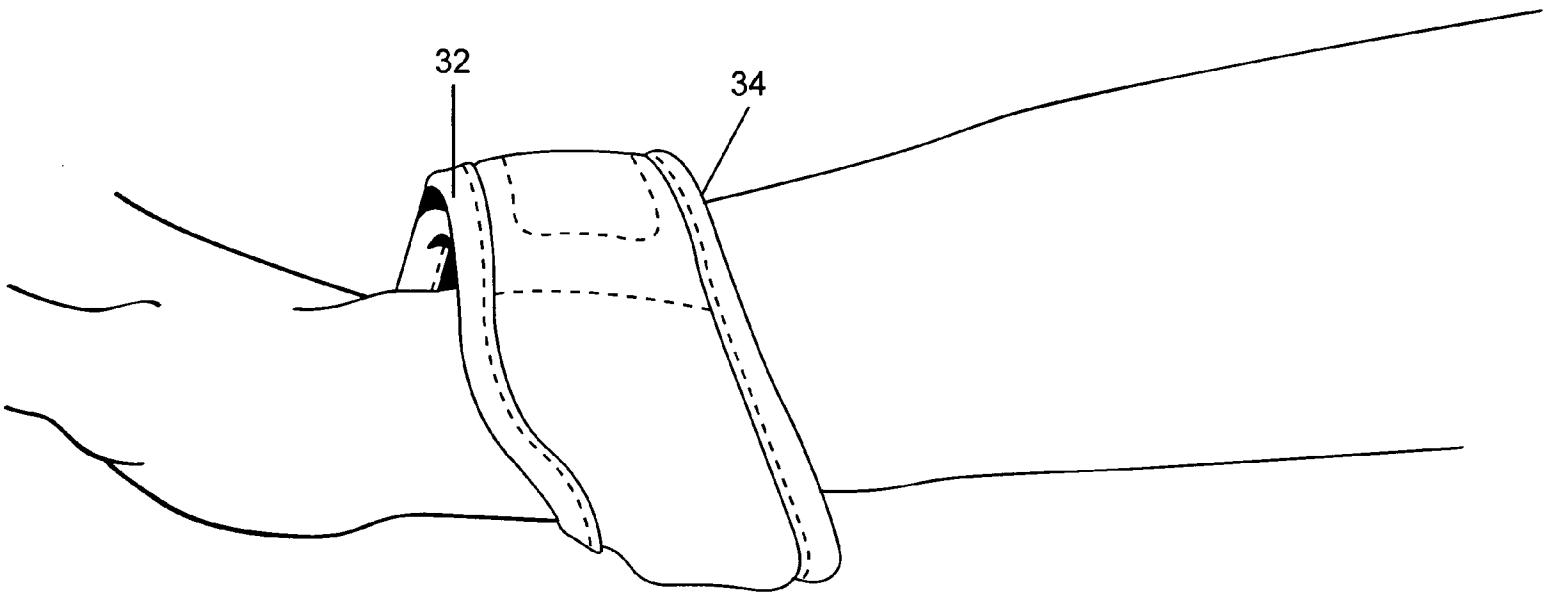
Figure 7:
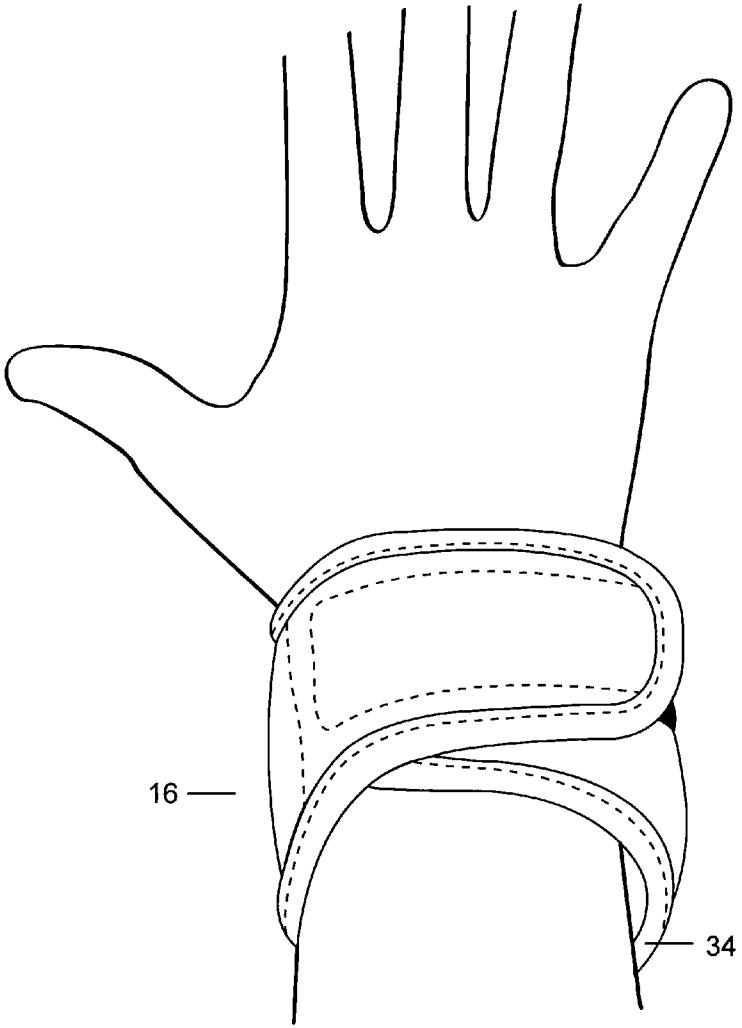

FIGS. 5, 6 and 7 illustrate the weighted wrist band 10 after it has been applied around the user's wrist. As can be appreciated, use of the complementary hook and loop fastening devices 22, 24 allows the wrist band 10 to be adjustably applied around the user's wrist, permitting the wrist band 10 to remain in place during a sports training exercise. The utilization of the weighted insert 26 having a plurality of metallic chips 30 inserted into a gel mold 28, creates a more stable, non weight shifting, environment within the pouch or pouches 38 of the weighted wrist band 10, thereby lessening the movement of the weight with respect to the prior art devices.

As briefly discussed above, the weighted insert or inserts 26 found in the pouches 38 of the first end section 14 and the offset cuff section 16 as shown in FIGS. 3 and 8 could also be included in the second end section 18. Alternatively, and although a preferred embodiment includes a pouch 38 in each of the first end section 14, second end section 18 and offset cuff section 16 due to the double layer construction of the weighted wrist band 10, it is appreciated the weighted wrist band could be constructed with fewer pouches and/or weighted insert in only one of the pouches. The stitching forming seam 20 as shown in FIGS. 1 and 2 permanently secures the weighted insert(s) 26 within one (or more) of the pouches 38, thereby preventing the removal of the weighted insert 26 after the stitching has been completed.

Alternatively, if a resealable opening is provided between the top and bottom fabric, that is the first sheet of material and the second sheet of material, the weighted insert can easily be removed and be replaced with differently weighted inserts. The use of the resealable openings would allow the weighted insert to be selectively included in one, two or three of the sections 14, 16 and 18.

FIGS. 1 and 2 illustrate an upper edge 66 defining a concave surface. It is important to note that the portion of the seam 20 extending between the coupled ends 42, 46 at a distance below the coupled ends 42, 46 would create the cuff section offset from the upper edge 70 of first end section 14 as well as being offset from the upper edge 74 of the second end section 18. This would allow the weighted wrist band 10 to be applied to the wrist of the user with the weighted wrist band to extend about the heel of the user's palm in such a manner to avoid contact with a particular sports implement, such as, but not limited to a basketball, volleyball, golf club, baseball bat, softball bat, racket or the like. Although FIGS. 1 and 2 illustrate the use of a curved periphery between coupled ends points 42, 46, the present invention intends to cover any configuration provided with the offset cuff section 16 below a line drawn between the coupled ends 42, 46 parallel to the longitudinal axes 62, 64.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. An exercise device adapted to be worn around an individual's wrist, comprising:

a band comprising a first end section, a second end section and an offset cuff section, the offset cuff section provided between the first end section and the second end section, the first end section including a first free end and a first coupled end, a first upper edge and a first lower edge, the first coupled end connected to a first end of the offset cuff section, and the second section including a second free end and a second coupled end, a second upper edge and a second lower edge, the second coupled end connected to a second end of the offset cuff section, the offset cuff section provided with a third upper edge and a third lower edge, the third upper edge spaced below the first and second upper edges, and the third lower edge spaced below the first and second lower edges, resulting in the offset cuff section offset with respect to the first end section and the second end section, the first end section, the second end section and the offset cuff section all provided on a single plane including a longitudinal axis extending from the first free end to the first coupled end, and a longitudinal axis extending from the second free end to the second coupled end;

the offset cuff section is positioned between and secured to the first end section and the second end section, and the offset cuff section includes a curved upper peripheral edge and wherein the offset cuff section has a partial annular shape and includes a curved lower peripheral edge, and the offset cuff section is spaced below a straight upper edge of the first end section and a straight upper edge of the second end section, an upper edge of the offset cuff section is offset from a line formed by the straight upper edge of the first end section and the straight upper edge of the second end section; with the pouch positioned between the curved upper peripheral edge and the curved lower peripheral edge, the curved upper peripheral edge defining a concave surface that fits beneath a heel of a palm a fastening device provided on the first end section and the second end section for fastening the first end section to the second end section;

wherein when the band is provided around the individual's wrist and the first end section is fastened to the second end section by the fastening device a continuous band is formed and the offset cuff section prevents contact between the band and the heel of the individual's palm as well as a sports implement used by the individual during exercise, wherein the curved upper peripheral edge is positioned at a front of the individual's hand, just below a heel of the individual's palm.

2. The exercise device according to claim 1, further comprising:

a weighted insert provided within the band, said weighted insert including a plurality of metallic chips included with a gel mold.

3. The exercise device according to claim 1, wherein the fastening device comprises a hook and loop type device provided on the first end section and a complementary hook and loop type device provided on the second end section.

4. The exercise device according to claim 2, wherein the fastening device comprises a hook and loop type device provided on the first end section and a complementary hook and loop type device provided on the second end section.

5. An exercise device adapted to be worn around an individual's wrist, comprising:

a band adapted to be worn around the individual's wrist; and a weighted insert provided within the band, said weighted mass including a plurality of metallic chips included within a gel mold;

said band is provided with a first end section, a second end section and an offset cuff section, said offset cuff section provided between said first end section and said second end section, said weighted insert included in at least one of said first end section, said second end section or said offset cuff section the offset cuff section is positioned between and secured to the first end section and the second end section, and the offset cuff section includes a curved upper peripheral edge and wherein the offset cuff section has a partial annular shape and includes a curved lower peripheral edge, and the offset cuff section is spaced below a straight upper edge of the first end section and a straight upper edge of the second end section, an upper edge of the offset cuff section is offset from a line formed by the straight upper edge of the first end section and the straight upper edge of the second end section, wherein the curved upper peripheral edge is positioned at a front of an individual's hand, just below a heel of an individual's palm.

* * * * *